US005269611A

United States Patent [19]

Funamoto et al.

[11] Patent Number: 5,269,611

[45] Date of Patent: Dec. 14, 1993

[54] HAMMER DRIVING MECHANISM FOR PRINTING APPARATUS

[75] Inventors: Masaya Funamoto, Nagoya; Naohisa Kaneko, Toyokawa, both of Japan

[73] Assignee: Brother Kogyo Kabushiki Kaisha, Nagoya, Japan

[21] Appl. No.: 601,921

[22] Filed: Oct. 23, 1990

[30] Foreign Application Priority Data

Oct. 24, 1989 [JP] Japan ..... 1-276698

[51] Int. Cl.[5] ..... B41J 9/36

[52] U.S. Cl. ..... 400/157.2; 400/695; 400/144.2; 101/93.3

[58] Field of Search ..... 400/144.2, 157.1, 157.3, 400/167, 166, 157.2, 185, 187, 695, 696, 697-697.1, 185; 101/93.18, 93.19, 93.28, 93.30, 93.31, 93.48, 93.02, 93.03, 93.35

[56] References Cited

U.S. PATENT DOCUMENTS 4,538,931 9/1985 Nagashima ..... 400/157.1
4,568,208 2/1986 Iwase ..... 400/166
4,746,236 5/1988 Shioda ..... 400/157.1

FOREIGN PATENT DOCUMENTS 0292283 11/1988 European Pat. Off. .
108741 7/1988 Japan .
2051684 1/1981 United Kingdom ..... 400/166

*Primary Examiner*—David A. Wiecking
*Attorney, Agent, or Firm*—Jones, Tullar & Cooper

[57] ABSTRACT

A hammer driving mechanism in a printing is arranged to prevent double striking during erasing operations. A controller is provided to control the hammer drive means or a stopper based upon whether an erase command or a print command is received.

11 Claims, 10 Drawing Sheets

HAMMER DRIVING MECHANISM FOR PRINTING APPARATUS

BACKGROUND OF THE INVENTION

1. Field of the Invention

The present invention relates generally to a printing hammer driving mechanism in a printing apparatus. More particularly, a hammer driving mechanism which prevents double striking at the time of erasing a character is disclosed.

2. Description of the Related Art

Printing devices equipped with hammer mechanisms that strike type elements of a type wheel hard are generally known. A printing apparatus of this type is disclosed in Published Unexamined Japanese Utility Model Application No. 63-108741. As seen in FIG. 12, such an apparatus has a DC hammer driving motor 51 that is driven on the basis of the operation of character keys or a correction key on a keyboard. Solenoid 52 is then excited (energized), so as to move an armature 53 to an unlock position from a lock position. A hook 60 provided at an upper end of the armature 53 engages a projection 61 of a rotary body 54 when the armature 53 is in the locked position, thus locking the rotary body 54. The hook 60 disengages the projection 61, when the armature 53 is moved to the unlocked position, thus unlocking the rotary body 54. This releasing of the lock rotates the rotary body 54, with a cam 55 rotating together with the rotary body 54. The rotation of the cam 55 causes a crank 56 to drive a printing hammer 57 to print a character through a print ribbon 58 or erase a character through a correction ribbon 59.

The solenoid 52 is deenergized during one revolution of the rotary body 54, moving the armature 53 again to the locked position. At a hold position, the hook 60 catches the projection 61, which has reached there with a slight delay after movement of the armature 53 to the locked position, stopping the rotation of the rotary body 54. This stops and holds the printing hammer 57 via the cam 55 and crank 56, which prepares the apparatus for the next key operation.

The hammer driving motor 51 also drives a winding spool during the printing operation to wind the print ribbon around the spool by a length corresponding to one character. The load applied to the drive motor 51 at the printing time is therefore greater than the load at the erasing time. Accordingly, the rotational cycle of the drive motor 51 or the rotary body 54 is faster at the erasing time than at the printing time.

If the time that the solenoid is energized is constant during the erasing action, the armature 53 may return to the locked position with a slight delay. This can allow the rotary body 54 to rotate to cause the projection 61 to reach the hold position. Thus, it would be too late for the armature 53 to catch the rotary body 54. In such a case, the hook 60 cannot catch the projection 61, which permits the rotary body 54 to keep rotating. Consequently, the cam 55 drives the printing hammer 57 via the crank 56 to perform a second hammering operation.

To overcome this shortcoming, the energizing time for the solenoid 52 is set such that the timing for the armature 53 to return to the locked position is slightly faster than the timing for the rotation of the rotary body 54 to position its projection 61 at the hold position, thereby allowing the hook 60 to catch the projection 61 in time to surely lock the rotary body 54. However, even with the above structure, these two timings may change due to a variation in rotational torque of the drive motor 51 with passage of time or an increase in the magnetic remanence of the solenoid 52. When the return timing of the armature 53 becomes equal to, or delayed with respect to the timing of the rotary body's return to the hold position, an extra hammering operation will be undesirably performed during the erasing cycle, as in the previously described case.

SUMMARY OF THE INVENTION

It is therefore a primary object of the present invention to provide a hammer driving mechanism for a printing apparatus, which controls the operation of a printing hammer during erasing operations to inhibit double striking.

It is another object of the present invention to provide a hammer driving mechanism for a printing apparatus, which can prevent malfunction of the printing hammer during erasing operations even when the rotational torque of a hammer driving motor changes with age.

It is a still another object of the present invention to provide a hammer driving mechanism for a printing apparatus, which can prevent malfunction of the printing hammer during erasing operations without being influenced by magnetic remanence.

It is a further object of the present invention to provide a hammer driving mechanism for a printing apparatus employing a hammer driving DC motor, that has a wider allowance for variations in operational characteristics.

It is a still further object of the present invention to provide a hammer driving mechanism for a printing apparatus, which can reduce the attracting stroke of an armature and permit the use of an inexpensive solenoid with weak magnetic attraction, contributing to lowering the manufacturing cost of the overall apparatus.

According to the first aspect of the present invention, the hammer driving mechanism has an input means for inputting various commands including a print command and an erase command. A selective moving means transmits movement to the printing hammer to selectively move the printing hammer between a print position and a non-print position. A drive means drives the selective moving means and the spool of the print ribbon to feed the print ribbon at a printing time. The drive means also drives the selective moving means at an erasing time. A compulsory stop means capable of moving into the moving path of the selective moving means is provided for engaging the selective moving means at a predetermined timing to catch the selective moving means to thereby forcibly stop moving the printing hammer. A selective holding means selectively holds the compulsory stop means at an interfering position and a non-interfering position. A control means is also provided to control the driving of at least one of the drive means and the compulsory stop means in accordance with the erase command from the input means in such a manner as not to delay the predetermined timing at which the compulsory stop means catches the selective moving means as compared with the predetermined time at the printing time.

According to a second aspect of the invention, the control means controls the driving of the drive means in accordance with the erase command such that the compulsory stop means can catch the selective moving means.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments together with the accompanying drawings of which:

DETAILED DESCRIPTION OF THE PREFERRED EMBODIMENT

A preferred embodiment of the present invention as embodied in a typewriter which mechanically drives a printing hammer, will now be described referring to the accompanying drawings.

To begin with, a description will be given of a printing hammer 7 and a hammer driving mechanism HM which drives this hammer 7.

Figure 2:
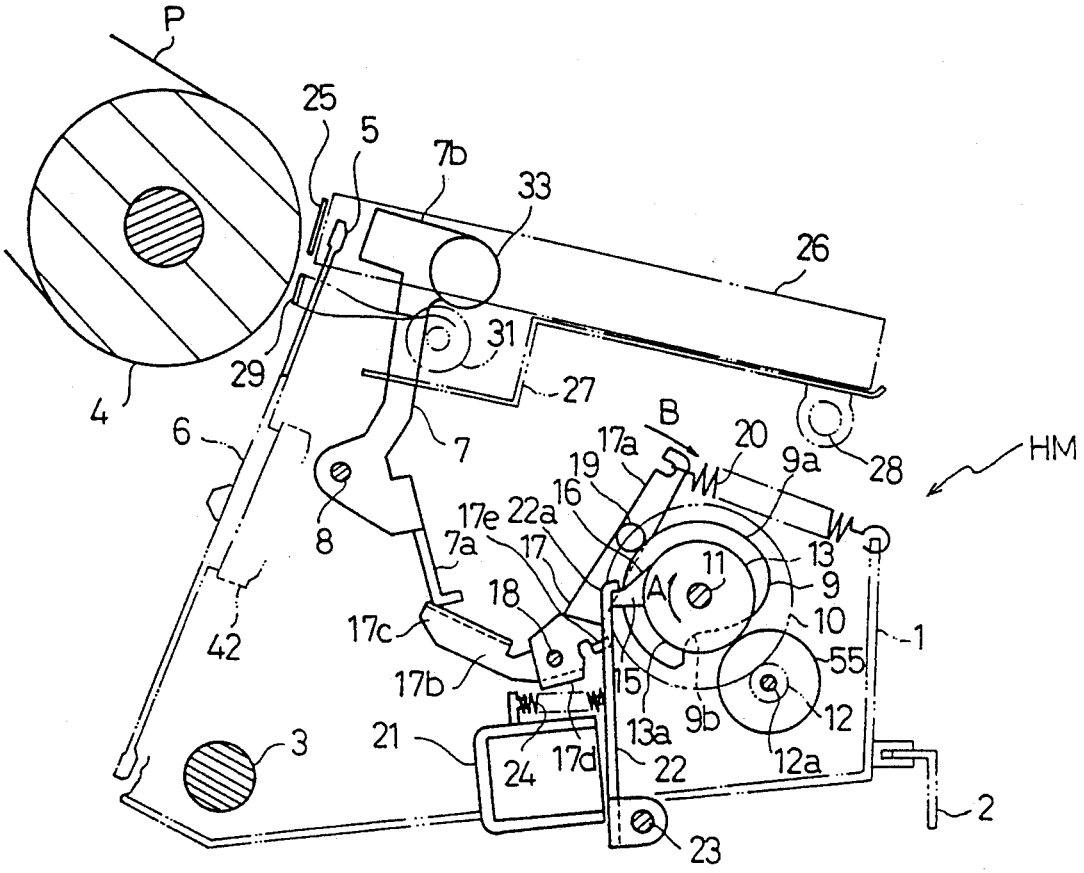
FIG. 2 is a side view of a lateral cross section of essential portions of the typewriter.

As shown in FIG. 2, a carriage 1 is supported on a guide plate 2 and a guide shaft 3 in a frame (not shown) in such a manner as to be movable along a platen 4. A type wheel 6 having a number of type elements 5 formed on its periphery is rotatably supported by the carriage 1. A type wheel motor 42, when rotated, selectively positions a desired type element 5 of the wheel 6 at a print position facing paper P set on the platen 4.

A printing hammer 7 is supported rockably the carriage 1 at the vicinity of the type wheel 6 by a support shaft 8. When not actually printing, the printing hammer 7 is withdrawn to a retreat position separated from the platen 4, as shown in FIG. 2. The hammer 7 is normally urged toward the retreat position by means of a spring (not shown). At the printing time, the printing hammer 7 is moved to a print position to strike a selected type element 5 toward the platen 4.

Figure 5:
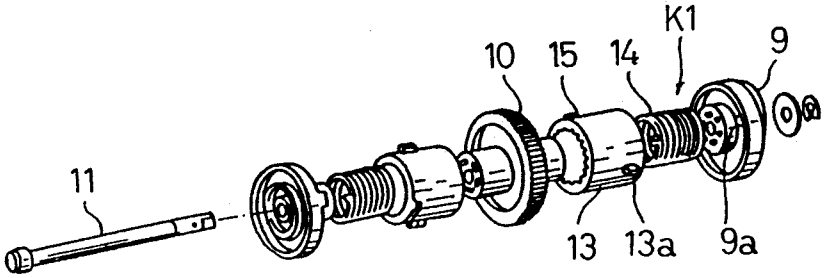
FIG. 5 is an exploded perspective view of a clutch mechanism portion.

A hammer driving cam 9 (hereinafter referred to as the "cam") and a driven gear 10 are supported rotatably on the carriage 1 by a shaft 11. The driven gear 10 engages with a drive gear 12 on a drive shaft 12*a* that is driven by a hammer driving motor 41. As seen in FIG. 5, a rotary body 13 is positioned between the cam 9 and the driven gear 10. The rotary body 13 has a clutch spring 14 disposed therein. The rotary body 13 is driven by the hammer driving motor 41 (see FIG. 7).

Figure 4:
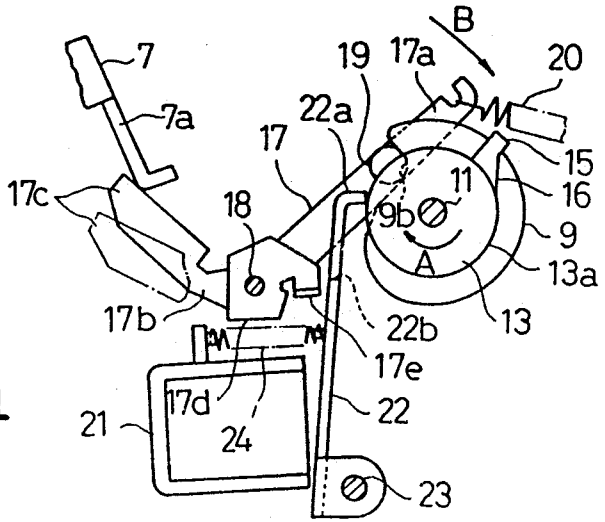
FIG. 4 is a side view of a lateral cross section of essential portions in a case where the armature is held at a third operational position and printing is done with a strong impact force.
Figure 3:
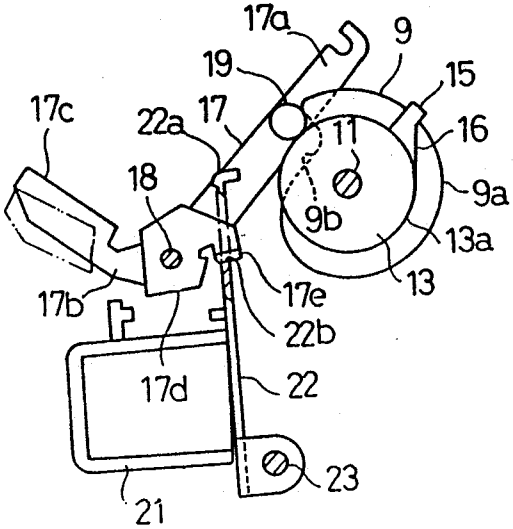
FIG. 3 is a side view of a lateral cross section of essential portions in a case where an armature is held at a second operational position and printing is done with a weak impact force.

The rotary body 13 has one end portion positioned within the cam 9. An engage pawl 9*a* of the cam 9 abuts on the upper surface of an engage pawl 13*a* of the rotary body 13. An engaging projection 15 protrudes from the outer surface of the rotary body 13, and has an inclined guide face 16 extending from a portion tangent to the outer surface of the rotary body 13 toward a mid portion of the projection 15, as shown in FIGS. 2 to 4. When the rotation of the rotary body 13 is restricted via the projection 15, the transmission of the rotational force of the driven gear 10 to the cam 9 is cut off by the clutch spring 14. Releasing the rotational restriction of the rotary body 13 permits the clutch spring to transmit the rotation of the driven gear 10 to the cam 9, turning the cam 9 in the direction of the arrow A.

Figure 6:
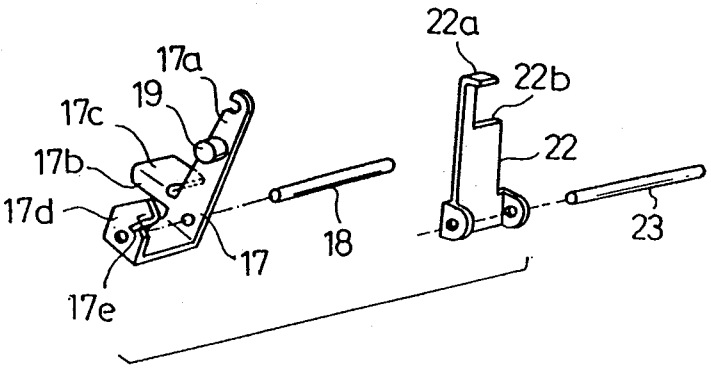
FIG. 6 is an exploded perspective view of a crank and armature.

As shown in FIG. 2, a nearly L-shaped crank (link member) 17 is supported pivotally at its center portion on the carriage I between the printing hammer 7 and cam 9 by a shaft 18. As shown in FIG. 6, the crank 17 has a first arm 17*a* on which a cam follower 19 that engages with the cam 9 is protrusively formed. The crank 17 also has a second arm 17*b* provided with an engage portion 17*c*, which engages with a link portion 7*a* of the printing hammer 7. The crank 17 further has a third arm 17*d* having an engage portion 17*e* formed at its distal end. The crank 17 is urged, by a tension spring 20, in such a direction that the cam follower 19 engages with the peripheral surface of the cam 9.

When the cam follower 19 is in abutment with an equal-diameter portion 9*a* of the cam 9, the crank 17 is at a wait position shown in FIG. 2 to hold the printing hammer 7 at the retreat position through engagement with the link portion 7*a*. As the cam 9 rotates in the direction of the arrow A, the cam follower 19 comes into engagement with a recess 9*b* of the cam 9 to be held at a striking position, as shown in FIG. 4. With the cam follower 19 at the striking position, the force of the tension spring 20 allows the crank 17 to turn in the direction of the arrow B.

A solenoid 21 is provided on the carriage I below the cam 9. An armature 22 disposed substantially normal to the solenoid 21 is pivotally supported by a shaft 23. A compression spring 24 is bridged between the solenoid 21 and the armature 22. When the solenoid 21 is not excited (not energized), the armature 22 is urged in a direction away from the solenoid 21 by the compression spring 24. A restricting step portion 22*b* is formed in the center portion of the armature 22 to limit the rotation of the crank 17 when in engagement with the engage portion 17*e* of the crank 17, as shown in FIG. 6.

When the solenoid 21 is energized, the armature 22 is not held at either a first operational position (see FIG. 2) at which a hook 22*a* formed at its upper end catches the projection 15 or a third operational position (see FIG. 4) at which the hook 22*a* engages with the outer surface of the rotary body 13 and the restricting step portion 22*b* lies out of the rotational locus of the engage portion 17*e* of the crank 17. The armature 22 at the first operational position restricts the rotation of the rotary body 13. At the third operational position, the armature 22 releases the rotational restriction of the rotary body 13 over a predetermined angle range and allows the crank 17 to turn to the striking position from the wait position.

When the solenoid 21 is energized, the hook 22*a* is disengaged from the projection 15, permitting the armature 22 to be held at a second operational position (see FIG. 3). Then, the rotational restriction on the rotary body 13 is released and the restricting step portion 22*b* comes within the rotational locus of the engage portion 17*e*.

Figure 7:
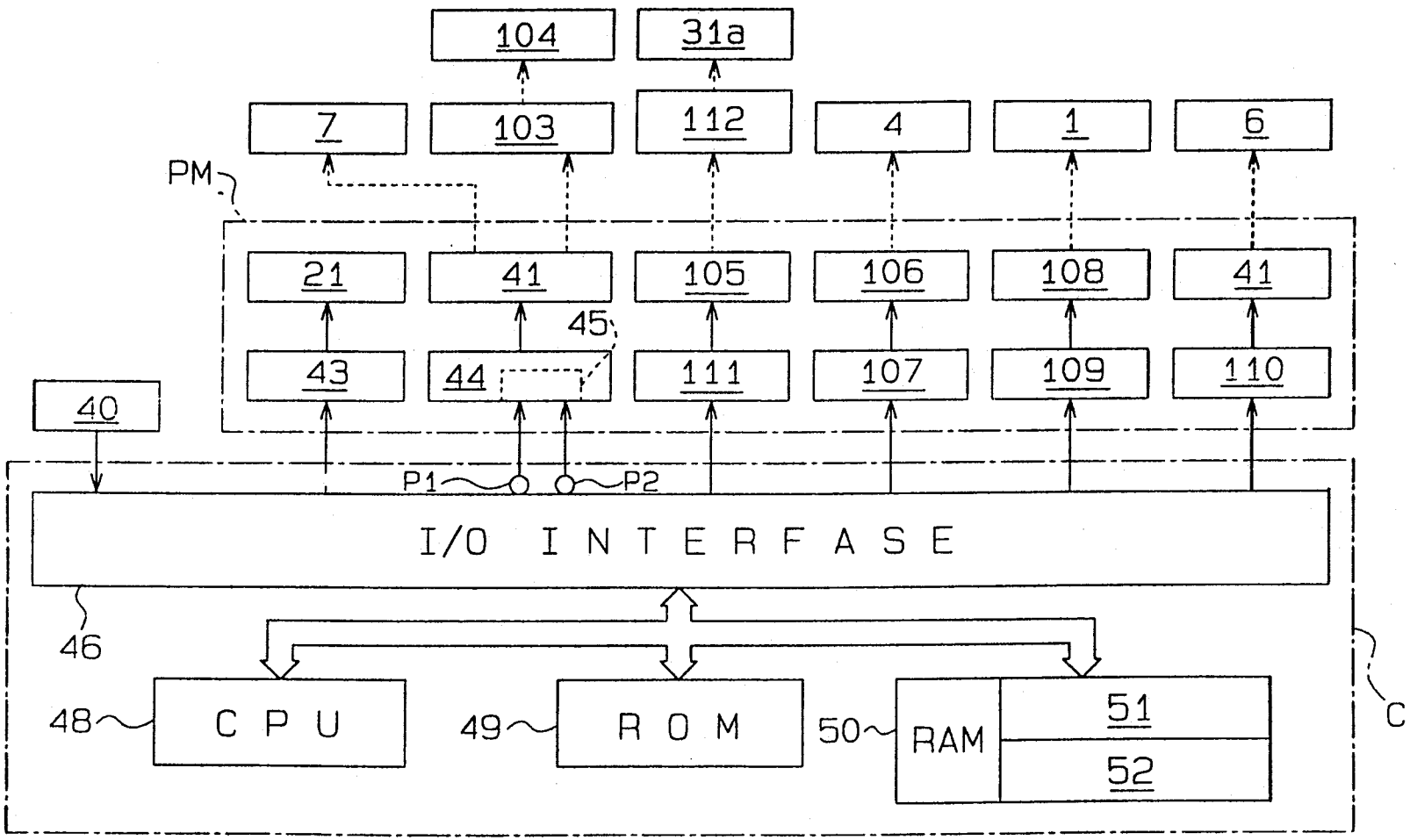
FIG. 7 is a block diagram illustrating the electrical structure of a control system for the typewriter.

A ribbon cassette 26 for retaining a print ribbon 25 is placed on a holder 27 whose front end portion is attached rotatably on the carriage 1. The print ribbon 25 is fed out from a feed spool of the ribbon cassette 26, and is wound around a wind spool 104 which is driven via a ribbon feed mechanism 103 by the hammer driving motor 41, as shown in FIG. 7. Directly below the print ribbon 25 lies a correction ribbon 29 which is fed from a feed spool 31.

These ribbons 25 and 29 are swiveled up and down by a holder swiveling mechanism (not shown), so that they come to the print position respectively at the printing time and the erasing time. The holder swiveling mechanism is designed in such a way that the swiveling amount of the holder 27 varies in accordance with a motion imparted by swivel motor 105. When the holder swivels a small amount, the print ribbon 25 comes to the print position, whereas when the print ribbon is swiveled a large amount, the correction ribbon 29 is moved to the print position. The swiveling action of the holder 27 drives the ratchet of a correction ribbon feed mechanism 112 to rotate a wind spool 31*a*, feeding the correction ribbon 20.

A description will now be given of the action of the thus constituted hammer driving mechanism HM to apply strong impact force to the printing hammer 7 at the printing time and the erasing time.

Figure 1:
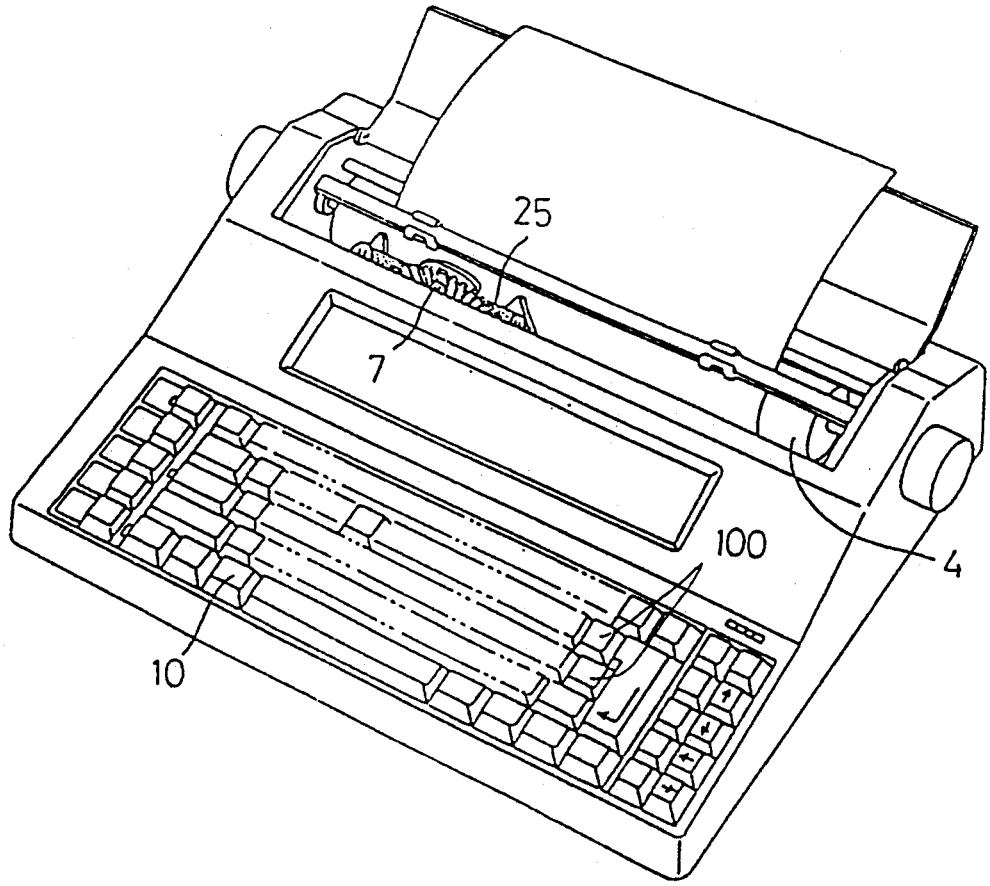
FIG. 1 is a perspective view of a typewriter with a printing apparatus of the present invention.

Let us assume that energizing the solenoid 21 has stopped, and the armature 22 is held at the first operational position by the compression spring 24, with the hook 22*a* catching the projection 15, as shown in FIG. 2. When a character key 100 or a correction key 101 on a keyboard 40 (see FIG. 1) is operated to print a strong character or to erase a character, the print ribbon 25 or correction ribbon 29 is moved to the print position and the hammer driving motor 41 is driven. As a result, the driven gear 10 rotates, but its rotational movement will not be transmitted to the cam 9 because the rotation of the rotary body 13 is restricted by its projection 15 caught by the hook 22*a* of the armature 22.

When the solenoid 21 is energized for a minute period of time thereafter, compression of the spring 24 tilts the armature 22 toward the solenoid 21, disengaging the hook 22*a* from the projection 15. The disengagement permits the clutch spring 14 in the rotary body 13 to transmit the rotation of the driven gear 10 to the cam 9, and the cam 9 starts rotating in the direction of the arrow A. After energizing of the solenoid 21 stops, the hook 22*a* engages the outer surface of the rotary body 13, holding the armature 22 at the third operational position shown in FIG. 4.

When the cam follower 19 comes in engagement with the recess 9*b* with the rotation of the cam 9, the crank 17 quickly turns to the striking position from the wait position. Following the motion of the crank 17, the printing hammer 7 rapidly rotates to the print position from the retreat position, striking a type element 5 with a strong impact force.

When the cam follower 19 engages with the equal-diameter portion 9*a* via the recess 9*b* thereafter, the crank 17 returns to the wait position and the printing hammer 7 returns to the retreat position from the print position accordingly. When the hook 22*a* of the armature 22 moves along the inclined guide face 16 with the rotation of the rotary body 13 to engage the projection 15, the rotation of the rotary body 13 is restricted. As a result, the clutch spring 14 inhibits the transmission of the rotational force of the driven gear 10, thus stopping the rotation of the cam 9.

The following describes the action of the printing hammer 7 to apply a weak impact force to the hammer 7 at the printing time and erasing time. The weak printing action is desired when certain "weak" characters such as the period, comma or the like are printed.

When a predetermined key operation is executed to print or erase a weak character, the print ribbon 25 or correction ribbon 29 moves to the print position. Then, the hammer driving motor 41 is driven, the solenoid 21 is energized for a long period of time, i.e. , the solenoid 21 receives a drive signal having an end period later than that sent to the solenoid 21 in the case of printing a strong character.

Consequently, the armature 22 is attracted for a predetermined period of time and is held at the second operational position, as shown in FIG. 3. This permits the engage portion 17 to abut on the restricting step portion 22*b* before the cam follower 19 engages the recess 9*b*. Therefore, the rotation of the crank 17 caused by the spring 20 is restricted, making the printing hammer 7 strike a type element 5 with a weak impact force.

The general structure of the control system for the typewriter will be explained below referring to FIG. 7.

A printing mechanism PM includes the solenoid 21 and its drive circuit 43, the hammer driving motor 41 and its drive circuit 44, the swivel motor 105 and its drive circuit 111, a platen motor 106 and its drive circuit 107, a carriage motor 108 and its drive circuit 109, and the type wheel motor 42 and its drive circuit 110. The drive circuits 43 and 44 are connected via an input/output (I/O) interface 46 of a control device C to the keyboard 40. The keyboard 40, like an ordinary typewriter, has character keys 100 including alphanumeric keys symbol keys, and various function keys including the correction key 101.

Figure 8:
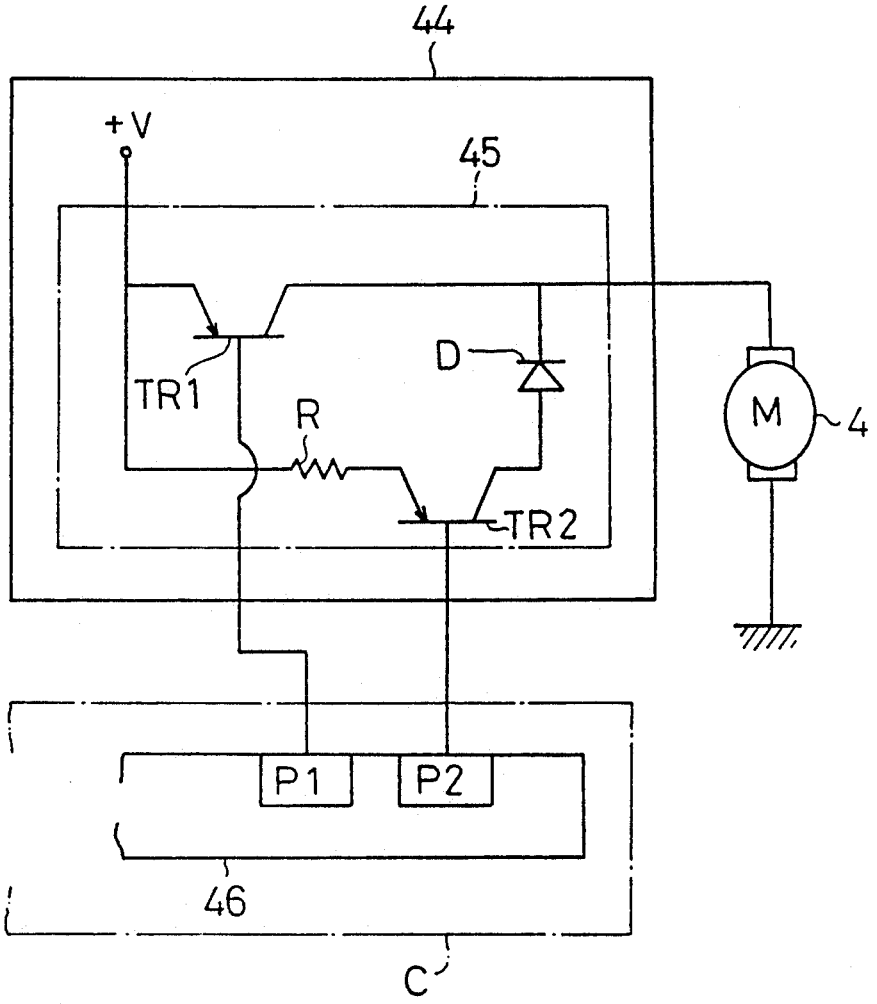
FIG. 8 is a circuit diagram of a voltage regulator.

The hammer driving motor 41 simultaneously drives the rotary body 13 and the wind spool 104 at the printing time, while it drives only the rotary body 13 at the erasing time. The rotational cycle of the motor 41 is therefore shorter at the erasing time than at the printing time. In this respect, as shown in FIG. 8, the drive circuit 44 is provided with a voltage regulator 45 which regulates the voltage of the drive signal applied to the motor 41, so that the motor 41 can rotate at approximately the same rotational cycle (rotational speed) at the printing time and the erasing time.

At the printing time, an "L"-level signal is output to an output port P1 of the I/O interface 46 and an "H"-level signal to an output port P2. Then transistor TR1 is rendered conductive to supply a reference voltage V (for example, 11 volts) to the hammer driving motor 41.

At the erasing time, on the other hand, an "H"-level signal is output to the output port P1 and an "L"-level signal to the output port P2. Then, only transistor TR2 is rendered conductive to drop the reference voltage V by a predetermined voltage corresponding to a resistor R to the hammer driving motor 41. Accordingly, the rotational cycle of the motor 41 becomes approximately the same as the one involved at the printing time. Letter "D" in FIG. 8 denotes a diode for preventing counter-flow of a current.

The control device C comprises a CPU 48, the I/O interface 46 connected to the CPU 48 via a bus 47, such as a data bus, an ROM 49 and an RAM 50. A control program for controlling the printing mechanism PM in accordance with code data entered using the individual character keys and function keys on the keyboard 40 is stored in ROM 49. The ROM also stores weak character data and a control program for the hammer driver. The weak character data includes a plurality of bits of weak character code data. The hammer driver controller directs the solenoid 21 to print a weak and strong character as well as erasers. It also controls the voltage applied to the hammer driving motor 41.

The RAM 50 has a present position memory segment for storing the present position of the carriage 1 in relation to an absolute origin. A print data memory segment 52 stores about 500 characters of printed character code data. Additionally various memories are provided for temporary storing the results of operations executed by the CPU 48.

The routines of the hammer driving control performed by the control device C of the typewriter will be discussed based on the flow chart in FIG. 9 with reference to the time charts given in FIGS. 10 and 11. Si (i=1, 2, 3 . . . ) in FIGS. 9(*a*) and 9(*b*) indicates individual steps of the operation done by the CPU 48.

Figure 9A:
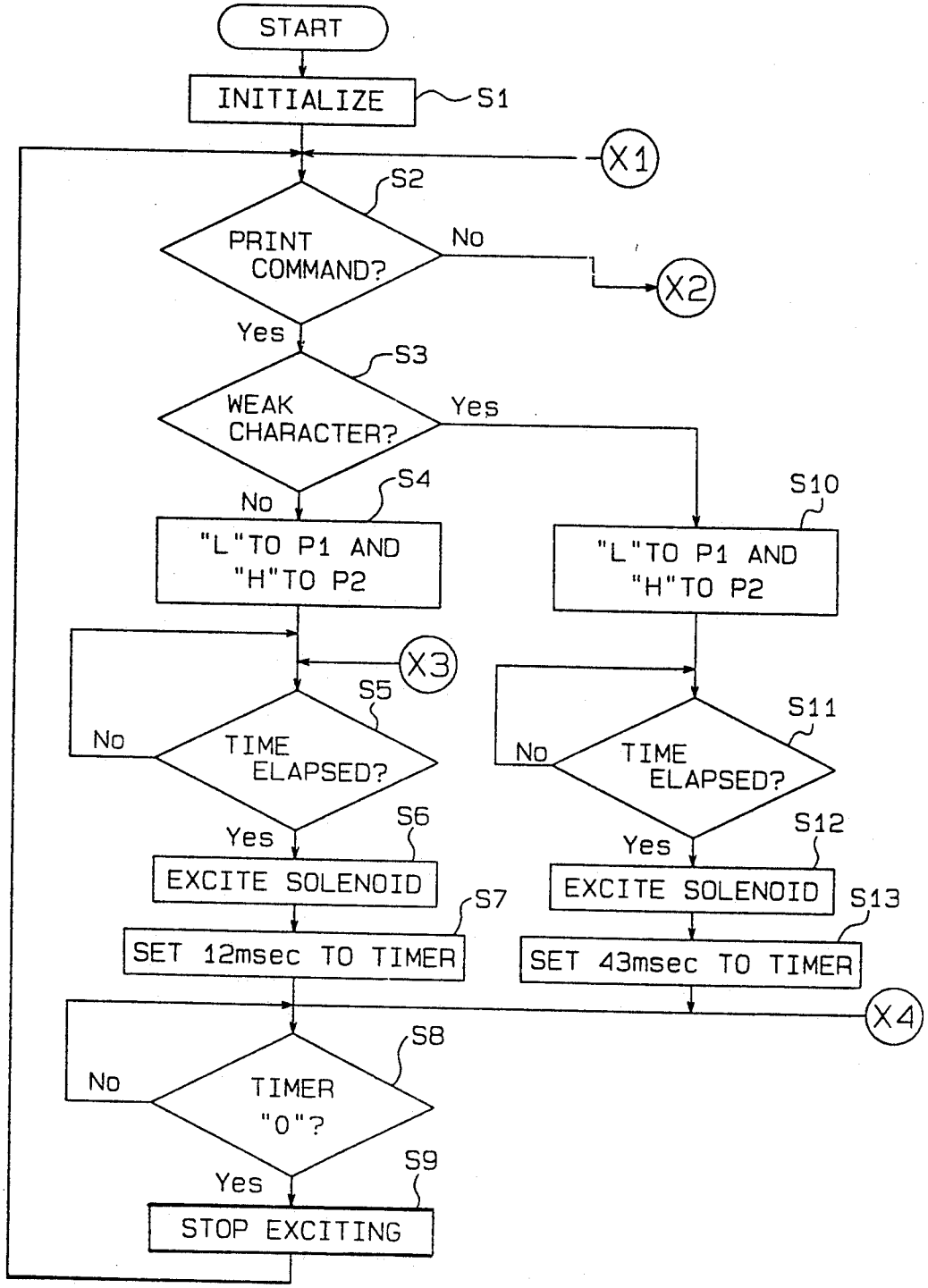
FIGS. 9(*a*) and 9(*b*) are flow charts of routines for controlling a hammer driving mechanism,respectively.
Figure 9B:
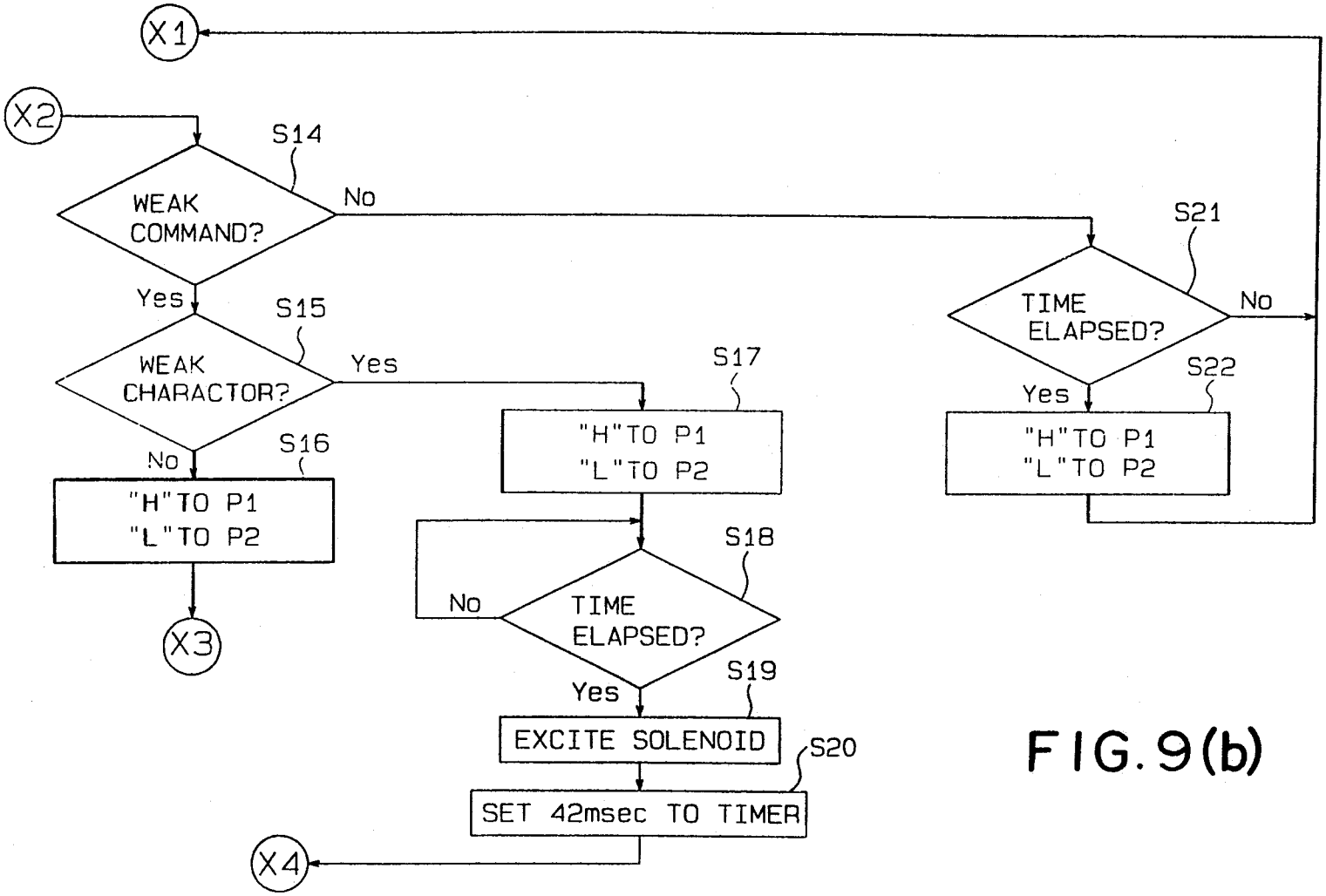

When the typewriter is activated, as shown in FIG. 9(*a*), the CPU 48 first executes the initialization (S1) When a strong character key on the keyboard 40 is operated (S2, S3), the CPU 48 sends an "L"-level signal to the port P1 and an "H"-level signal to the port P2 (S4). The hammer driving motor 41 is therefore driven by the reference voltage V. After a predetermined period of time (e.g., 60 msec) has elapsed (S5), the rotation of the motor 41 becomes stable and the solenoid 21 is excited for about 12 msec (S6–S9). The flow then returns to S2.

Figure 10:
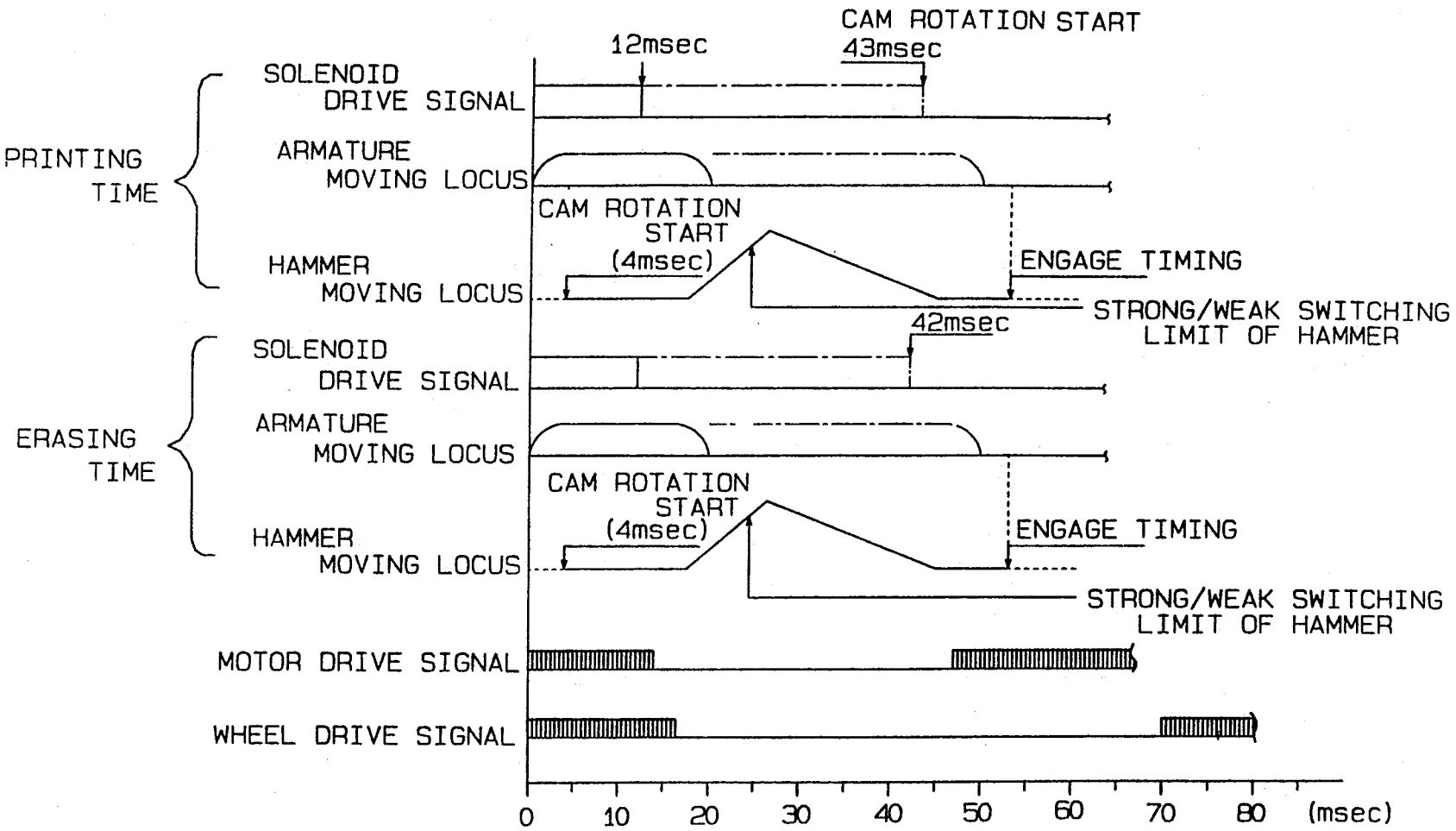
FIG. 10 is a time chart for individual portions of the hammer driving mechanism in a case where a hammer driving motor having a relatively short cycle is used.

If the rotational cycle of the hammer driving motor 41 is relatively short (e.g. , about 55 msec) as shown in FIG. 10, with the drive start point of the solenoid 21 being "0," the hook 22*a* of the armature 22 is disengaged from the projection 15 after approximately 4 msec and the cam 9 starts rotating, permitting the printing hammer 7 to print with a strong impact force as described earlier. After the printing is completed, the hook 22*a* of the armature 22 surely engages with the projection 15 (refer to the engage timing).

Figure 11:
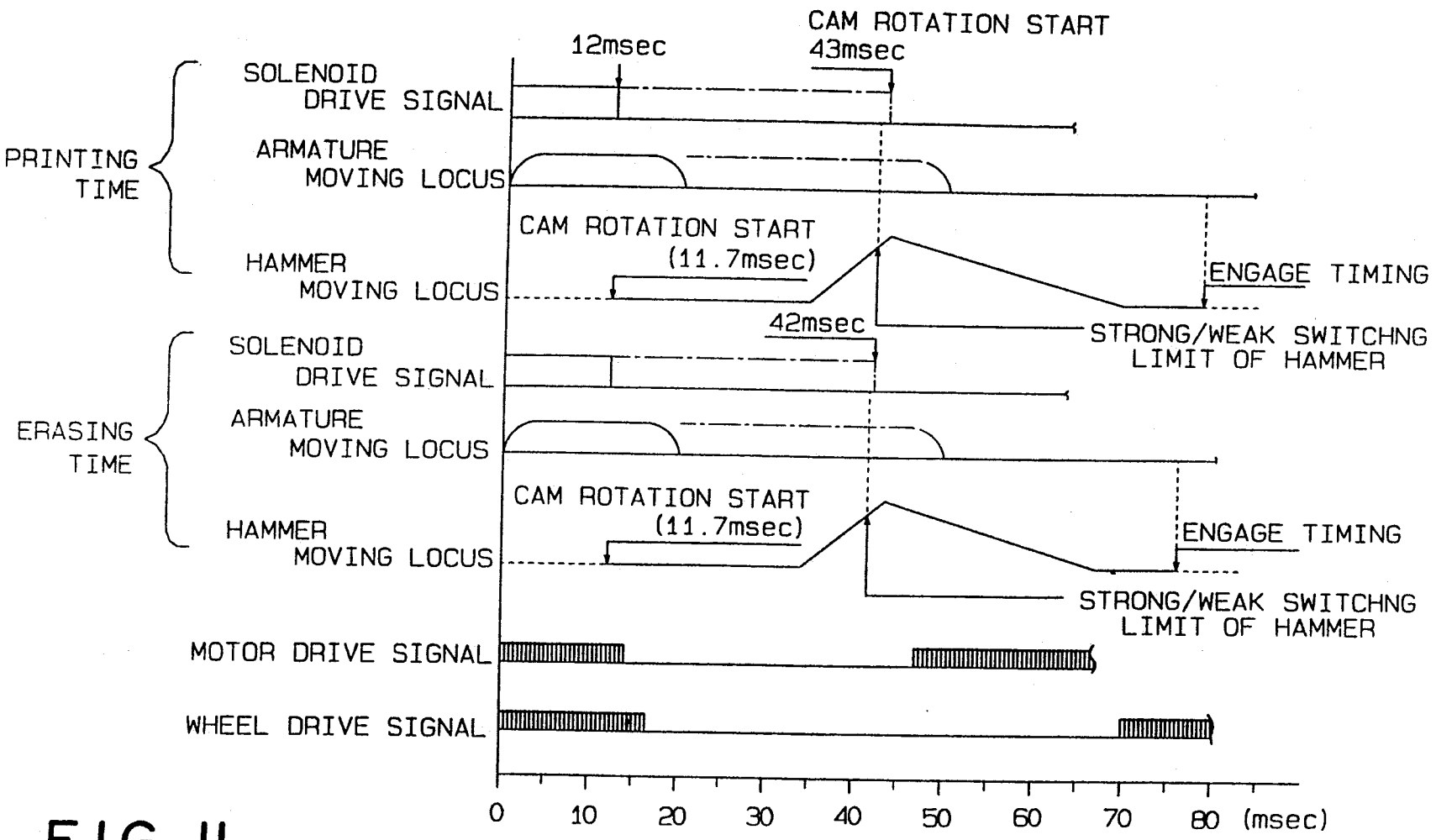
FIG. 11 is a time chart for individual portions of the hammer driving mechanism in a case where a hammer driving motor having a relatively long cycle is used.
Figure 12:
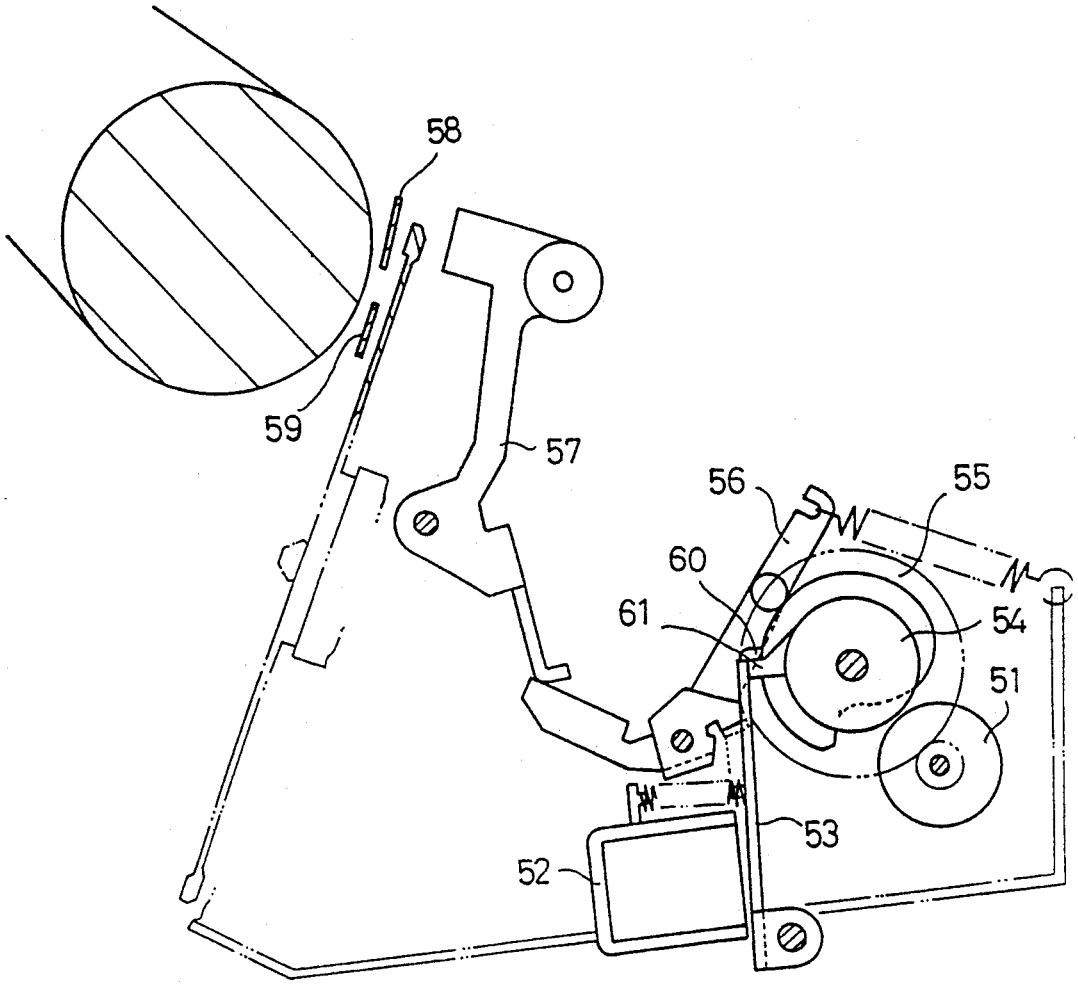
FIG. 12 (Prior Art)
FIG. 12 is a side view of a lateral cross section of essential portions of a typewriter according to the prior art.

If the rotational cycle of the hammer driving motor 41 is relatively long (e.g., about 73 msec) as shown in FIG. 11, the hook 22*a* of the armature 22 is disengaged from the projection 15 after approximately 11.7 msec and the cam 9 starts rotating. This allows the printing hammer 7 to print with a weak impact force. After the printing is completed, the hook 22*a* of the armature 22 surely engages the projection 15.

As should be apparent from the above, the hammer driving motor 41 is very tolerant of variations in rotational speed.

Returning to FIG. 9(*a*), the description of the control, routine will be continued. Upon reception of a print command from the CPU 48 in accordance with the operation of a weak character key included in the character keys (S2, S3), the hammer driving motor 41 is driven on the reference voltage V (S10) as done in S4. When a predetermined period of time has elapsed (S11), the solenoid 21 is excited for about 43 msec (S12, S13, S8, S9). The flow then returns to S2.

If the rotational cycle of the hammer driving motor 41 is relatively short as shown in FIG. 10, the armature 22 is held at the second operational position exceeding the strong/weak switching limit of the printing hammer 7 as indicated by the one-dot chain line. In this state, the printing hammer 7 prints with a weak impact force as described earlier. Since the timing for engagement between the hook 22*a* and the projection 15 comes after the armature 22 returns to the third operational position, double printing by the printing hammer 7 can surely be prevented.

When the correction key is operated for autocorrection, the CPU 48 determines whether a strong character or weak character should be erased on the basis of data stored in the present position memory 51, as shown in FIG. 9(*b*), data in the print data memory 52 and weak character data in the ROM 49 (S14, S15). The CPU sends an "H"-level signal to the port P1 and a "L"-level signal to the port P2 when a strong character is to be erased (S16). At this time, a voltage ΔV lower than the reference voltage V is applied to the hammer driving motor 41, so that the motor 41 is driven to have a rotational cycle about the same length of time as the printing cycle. Then, the steps including and following S5 will be executed. The solenoid 21 is excited for about 12 msec after elapse of a predetermined period of time. The flow then returns to S2. The erasing is performed with a strong impact force irrespective of whether the rotational cycle of the motor 41 is short (see FIG. 10) or long (see FIG. 11), and the hook 22*a* of the armature 22 surely engages with the projection after completion of the erasing operation in either case.

To erase a weak character (S14 and S15), the hammer driving motor 41 is driven by a voltage ΔV lower than the reference voltage V (S17) as done in S16. After a predetermined period of time has elapsed (S18), the solenoid 21 is excited for about 42 msec (S18–S20), then the flow returns to S2. In other words, the exciting time of the solenoid 21 for erasing a weak character is set shorter than for printing a weak character. Thus the rotational cycle of the hammer driving motor 41 is slightly shorter at the erasing time than at the printing time. Accordingly, weak characters can effectively be erased even when the rotational cycle of the motor 41 is relatively long (FIG. 11). Additionally, the hook 22*a* of the armature can surely engage with the projection 15 after the erasing is completed, thereby preventing double erasing of the weak character, even when the rotational cycle is relatively short (FIG. 10).

When no print or erase commands are output from the CPU 48 for a predetermined time (e.g. , 150–250 msec) (S21), an "H"-level signal is sent to the ports P1 and P2, stopping the hammer driving motor 41 (S22).

FIGS. 10 and 11 respectively illustrate the driven status of the carriage motor and the driven status of the type wheel motor in memory print mode. It should be apparent from these time charts that the print and erasing can properly be executed even in memory print mode.

As described above, the drive voltage applied to the hammer driving motor 41 at the erasing time is set lower than the voltage applied at the printing time in order to make the rotational cycle of the motor 41 at the erasing time approximately the same as the rotational cycle at the printing time. The end of the drive signal to the solenoid 21 for erasing a weak character is set earlier than that for printing a weak character according to the rotational cycle of the motor 41. When erasing, and particularly when erasing a weak character, the rotational phase of the rotary body 13 at the return timing of the armature and at the rotation-restricting timing of the armature 22 (engage timing) each become approximately equal to those of the corresponding print timings, particularly, at the time of printing a weak character. Thus, there is enough time between these two timings to surely inhibit a malfunction (double striking) of the hammer 7.

Further, since the timing for engagement of the hook 22*a* of the armature 22 with the projection 15 is sufficiently slower than the timing for the armature 22 to return to the operational position, a malfunction of the hammer 7 (unnecessary extra striking) at the time of erasing a weak character can surely be prevented. This is true even when the return timing of the armature 22 is delayed due to a variation in rotational torque of the motor 41 with age or an increase in the magnetic remanence of the solenoid 21, as well as when the engage timing for the hook 22*a* and projection 15 is quickened.

In addition, the armature can restrict the rotary body 13 at a position close to the solenoid 21, so that the attracting stroke of the armature 22 can be set smaller. This permits the use of an inexpensive solenoid with weak magnetic attraction which contributes to reducing the manufacturing cost of the overall apparatus.

The time of energizing the solenoid 21 at the time of erasing a strong character may be set shorter than that required to print a strong character.

Further, control may be accomplished by either regulating the timing of the drive voltage applied to the hammer driving motor 41 or the end of the drive signal supplied to the solenoid 21. The effect described above can be attained in either case.

What is claimed is:

1. In a printing apparatus equipped with a printing hammer for selectively striking a sheet on a platen through a print ribbon and a correction ribbon wound around an associated spool to execute printing and erasing operations, a hammer driving mechanism comprising:

a keyboard including character keys for inputting print commands and a correction key for inputting erase commands;

a rotatable crank provided engageable with the printing hammer and including means urging said crank in a direction to move the printing hammer to the print position;

a cam follower provided on the rotatable crank;

a cam for rotating the rotatable crank via the cam follower when rotated in engagement with the cam follower;

a rotary body provided to transmit power to the cam;

an electric motor which rotates based on commands from the keyboard driving the cam and the spool of the print ribbon to feed the print ribbon at a printing time, and for driving only the cam at an erasing time;

a movable bar which protrudes into the rotational locus of the rotatable plate at a predetermined timing to catch a part of the rotatable plate to forcibly stop movement of the printing hammer;

an electromagnetic solenoid for moving the movable bar into and away from the rotational locus of the rotary body for selectively positioning the movable bar at an engaging and a non-engaging position; and a controller for applying a voltage of a first level to said motor in response to a print command from said keyboard, and a voltage of a second level lower than the first level in response to an erase command from said keyboard, wherein said selective holding means comprises an electromagnetic solenoid, and wherein said control means energizes the solenoid for a shorter period of time in response to the erase command for the erasing operation than in response to the print command for the printing operation.

2. In a printing apparatus equipped with a printing hammer for selectively striking a sheet on a platen through a print ribbon and a correction ribbon wound around an associated spool to execute printing and erasing operations, a hammer driving mechanism comprising:

input means for inputting print commands and erase commands;

selective moving means for selectively moving the printing hammer between a print position and a non-print position;

drive means for driving the selective moving means and the spool of the print ribbon to feed the print ribbon at a printing time, and for driving only the selective moving means at an erasing time, said drive means including a motor;

compulsory stop means for engaging the selective moving means at respective predetermined timings for a printing operation and an erasing operation to catch the selective moving means to forcibly stop movement of the printing hammer toward the printing position;

selective holding means for selectively positioning the compulsory stop means at an engaging and a non-engaging position; and control means for applying a voltage of a first level to said motor during the printing operation, and a voltage of a second level lower than the first level during the erasing operation, wherein said selective holding means comprises an electromagnetic solenoid, and wherein said control means energizes the solenoid for a shorter period of time in response to the erase command for the erasing operation than in response to the print command for the printing operation.

3. A hammer printing apparatus according to claim 2, wherein the input means is a keyboard including character keys and a correction key.

4. A hammer printing apparatus according to claim 3, wherein the selective moving means comprises:

a rotatable crank provided engageable with the printing hammer and including means urging said crank in a direction to move the printing hammer to the print position;

a cam follower provided on the rotatable crank;

a cam for rotating the rotatable crank via the cam follower when rotated in engagement with the cam follower; and a rotary body provided to transmit power to the cam.

5. A hammer printing apparatus according to claim 3, wherein the drive means is an electric motor which rotates based on commands from the keyboard.

6. A hammer printing apparatus according to claim 5, further including means to drive the electric motor in a rotational cycle in the range of approximately 55 msec to approximately 73 msec.

7. A hammer printing apparatus according to claim 4, wherein the compulsory stop means is a movable bar which protrudes into a rotational locus of the rotary body at a predetermined timing to catch a part of the rotary body to stop rotation thereof.

8. A hammer printing apparatus according to claim 7, wherein the selective holding means is an electromagnetic solenoid for moving the movable bar into and away from the rotational locus of the rotary body.

9. A hammer printing apparatus according to claim 8, wherein the rotary body has a projection formed thereon and the movable bar has a hook portion formed at one end for catching the projection.

10. A hammer printing apparatus according to claim 5, wherein the control means comprises:

a drive circuit including a first transistor located between a reference voltage source and the electric motor, and a series circuit of a second transistor and a resistor, connected in parallel to the first transistor; and a controller, connected to the drive circuit, for selectively driving the first and second transistors in response to operations of the character keys and the correction key.

11. A hammer printing apparatus according to claim 2, wherein:

the selective holding means includes a solenoid;

the control means drives the solenoid using a drive signal; and the drive signals outputted in response to the erase command have an earlier relative end timing when compared to drive signals outputted in response to the print command.

* * * * *